United States Patent [19]

Braver

[11] Patent Number: 4,462,460

[45] Date of Patent: Jul. 31, 1984

[54] MODULAR AIR CONDITIONING APPARATUS

[75] Inventor: Alvin S. Braver, Oklahoma City, Okla.

[73] Assignee: International Environmental Corporation, Oklahoma City, Okla.

[21] Appl. No.: 293,697

[22] Filed: Aug. 17, 1981

Related U.S. Application Data

[63] Continuation of Ser. No. 040,585, May 21, 1979, abandoned, which is a continuation-in-part of Ser. No. 932,274, Aug. 9, 1978, Pat. No. 4,169,500.

[51] Int. Cl.[3] ..... F25B 29/00; F24F 3/00

[52] U.S. Cl. ..... 165/26; 165/50; 165/76; 62/160; 62/259.1

[58] Field of Search ..... 165/22, 26, 27, 29, 165/48, 50, 58, 62, 76; 62/159, 160, 324, 259.1

[56] References Cited

U.S. PATENT DOCUMENTS

| | | | |
|---|---|---|---|
| Re. 30,245 | 4/1980 | Whalen | 165/16 X |
| 3,411,569 | 11/1968 | Hildreth | 165/65 X |
| 3,523,575 | 8/1970 | Olivieri | 165/50 X |
| 3,547,186 | 12/1970 | McGrath | 165/50 X |
| 3,648,766 | 3/1972 | Whalen | 165/50 X |
| 3,722,580 | 3/1973 | Braver | 165/50 |
| 3,742,725 | 7/1973 | Berger | 165/48 X |
| 3,908,750 | 9/1975 | Siegel | 165/50 X |
| 4,019,570 | 4/1977 | Siegel | 165/76 X |
| 4,072,187 | 2/1978 | Lodge | 165/48 X |
| 4,127,162 | 11/1978 | Braver | 165/50 |

*Primary Examiner*—Samuel Scott
*Assistant Examiner*—Margaret A. Focarino
*Attorney, Agent, or Firm*—Dunlap & Codding

[57] ABSTRACT

An improved modular air conditioning apparatus utilizing heat pump assemblies and capable of heating or cooling adjacent room areas separated by a common wall partition. The apparatus comprises a first housing compartment and a second housing compartment which are supported by vertical riser ducts, each such housing compartment disposed adjacent to one of the room areas and characterized by three access sides, and one non-access side. One access side in each housing compartment is selected as a component access side. Adjacent non-access sides of each housing compartment define a vertical riser duct. A heat pump assembly is disposed in each housing compartment and a blower draws air through the condenser-evaporator thereof. All working components are removable through access ports provided by the removal of intake grille assemblies disposed at the component access side selected for each housing compartment placement. Riser pipes disposed in the vertical riser duct supply circulating water to the heat pump assemblies. Control assemblies sense external temperature and control the operation of the heat pump assemblies and blowers.

9 Claims, 9 Drawing Figures

MODULAR AIR CONDITIONING APPARATUS

CROSS REFERENCE TO RELATED APPLICATION

This application is a continuation of application Ser. No. 40,585, filed May 21, 1979, now abandoned, which is a continuation-in-part of application Ser. No. 932,274, filed Aug. 9, 1978, now U.S. Pat. No. 4,169,500.

BACKGROUND OF THE INVENTION

1. Field of the Invention

The present invention relates generally to improvements in air conditioning apparatus, and more particularly, but not by way of limitation, to modularly installed air conditioning equipment making use of heat pump assemblies.

2. Description of the Prior Art

The prior art contains many teachings of heating and cooling units of the type utilizing a fan blowing air which has been heated or cooled by a heat exchanger apparatus. Generally, the prior art heating and cooling units were designed to provide heated or cooled air only to one room area, thereby requiring field installation of one unit for each room area to be heated and cooled. The bulky external plumbing and consumption of floor space which were entailed with prior art units were reduced by the air conditioning unit described in the Applicant's U.S. Pat. No. 3,722,580, which disclosed a modular unit which could heat or cool two horizontally adjacent room areas separated by a common vertical partition within which the unit was installed. Each modular unit contained two independent room units, which were separated by a riser duct; and the modular units could be vertically stacked for use on separate floors of a multiple-story building. Pipes which extended vertically within the riser duct supplied heat exchange fluid to the unit on each floor. The air conditioning unit thus disclosed was not only smaller, but was also simpler and less costly to install than the prior art units.

Further advances in ease and flexibility of installation and operation of modular air conditioning units were disclosed in the Applicant's U.S. Pat. No. 4,127,162. The major components of the modular unit there disclosed could be arranged within a frame so as to face any one of three access sides of the unit, any one of which could be positioned adjacent to the room area to be heated or cooled. Thus, for example, a unit's blower could be oriented on the side of the frame providing the best air flow arrangement within the room being heated or cooled. Furthermore, all of the major components of the individual units were designed to be easily removed and replaced, for convenient installation and service. In addition, the heat exchange apparatus was disposed downstream from the blower, rather than upstream as was generally the case in the prior art. This improvement permitted the use of a larger heat exchanger in the unit, allowing a more even air distribution in the exchanger and thus more efficient heating and cooling.

In the Applicant's U.S. Pat. No. 4,169,500, a double modular unit was disclosed for the heating and cooling of two horizontally adjacent room areas separated by a vertical partition. This double unit featured many of the advantages of the above-mentioned patents, including multiple access sides and disposition of the heat exchanger downstream from the blower in each unit.

While the improvements embodied in these previous patents and applications have proven significant, subsequent developments have indicated that further improvements of the economy and efficiency of the unit disclosed in the parent application may be accomplished by the use of the heat pump assemblies. The principle of the heat pump, also known as reverse air conditioning, has been well known for over a century. However, its application to air conditioning equipment was not widely considered prior to 1973, when the domestic fuel shortage stimulated a search for methods of conserving energy.

The principle of the heat pump is based on the use of a closed loop of refrigerant fluid to move heat from one area to be dissipated at another area. Instead of generating heat, as does the conventional fossil fuel furnace, the heat pump uses energy to move energy, and does its job at about half the operating cost required by conventional air conditioning apparatus.

A typical water-source heat pump apparatus has an air-to-refrigerant heat exchanger and a water-to-refrigerant heat exchanger. Initially, a compressor compresses the refrigerant, and by means of precision valving, the compressed fluid is passed to either the water-to-refrigerant heat exchanger or the air-to-refrigerant heat exchanger. The water-to-refrigerant coil receives a stream of water from a water source and discharges water which is either higher or lower in temperature, depending on whether the heat pump is in the heating or cooling mode. The air-to-refrigerant exchanger receives a stream of air from the room to be heated or cooled, and discharges air which is either hotter or cooler than the intake air, depending on the heat pump's operational mode. In the cooling mode of the heat pump, the refrigerant is first passed through the water-to-refrigerant heat exchanger and then through the air-to-refrigerant exchanger. In the heating mode, this is reversed, with the refrigerant first being passed through the air-to-refrigerant exchanger and then through the water-to-refrigerant coil. In effect, during winter months, heat is extracted from the water stream by the refrigerant, which in turn transfers the heat to room air. In the summer months, heat from room air is picked up by the refrigerant, which in turn transfers the heat to the water stream.

While the modular air conditioning units employing heat pump assemblies have been utilized previously, prior art units do not provide ease of access, and such units take up an undue amount of floor space. Accordingly, it would be desirable to provide a modular air conditioning unit which offers the economic advantages of the heat pump while providing ease of access, flexibility of component placement and compactness of design.

SUMMARY OF THE INVENTION

The present invention contemplates an air conditioning apparatus of the type requiring connection to a source of recirculated fluid heat transfer medium for simultaneously heating or cooling a first room area and a second room area separated by a common vertical partition, with the air conditioning apparatus being disposed between the room areas. The air conditioning apparatus comprises a housing assembly which is formed from a first housing compartment associated with the first room area and a second housing compartment associated with the second room area, each of the housing compartments having three access sides, through a selected one of which the working components of the apparatus are accessible. First and second mid-panel members are supported respectively by the first housing compartment and the second housing compartment so as to separate each housing compartment into an upper plenum section and a lower operating section.

A first blower is supported by the first mid-panel member in the operating section of the first housing compartment to blow air from the operating section through an opening in the first mid-panel member into the plenum section. In like manner, a second blower is supported by the second mid-panel member in the operating section of the second housing compartment to blow air from the operating section through an opening in the second mid-panel member into the plenum section. A heat pump assembly having an air-to-refrigerant heat exchanger is disposed in each housing compartment so that each air-to-refrigerant heat exchanger is positioned along a selected access side in its respective operating section. Control means are provided in each of the housing compartments for sensing the temperature in the room area serviced by the respective housing compartment and for controlling the operation of the respective blower and heat pump assembly in response to the temperature sensed.

An outlet grille assembly is supported by each of the housing compartments on a selected access side and is disposed to direct air from the plenum sections to the respective room areas. Similarly, intake grille assemblies are supported by the housing compartments in intake air relationship to the heat exchangers, each of the apertures accomodating the intake grille assemblies defining, when the assemblies are removed, an access port through which the blower and heat pump assemblies may be removed from the operating section.

Supply means and return means provide fluid communication between the source of heat transfer medium and each of the heat pump assemblies disposed in the operating section of the housing compartments. Also, condensate drain means are provided for collecting and disposing of condensate from the heat pump assemblies.

Electrical heaters may be provided at the outlet of the blowers as alternative means of heating the air passing from the operating sections to the plenum sections of the housing compartments.

Accordingly, an object of the present invention is to provide an improved air conditioning apparatus which facilitates the servicing of the working components of the apparatus and simultaneously offers the energy economy of the heat pump.

Another object of the present invention is to provide an improved air conditioning apparatus utilizing a heat pump assembly which is compactly disposable between two adjacent room areas of a building, and which provides independent heating and cooling for each room area.

Other objects, features and advantages of the present invention will be apparent from the following detailed description of the presently preferred embodiments of the invention when taken in conjunction with the accompanying drawings and appended claims.

BRIEF DESCRIPTION OF THE DRAWINGS

FIG. 5 is a side elevational view of the heat pump assembly utilized in the air conditioning apparatus of FIG. 1.

FIG. 6 is an enlarged and partial cutaway view showing the electrical heater and the control assembly of the air conditioning apparatus of FIG. 1.

DESCRIPTON OF THE PREFERRED EMBODIMENT

Figure 1:
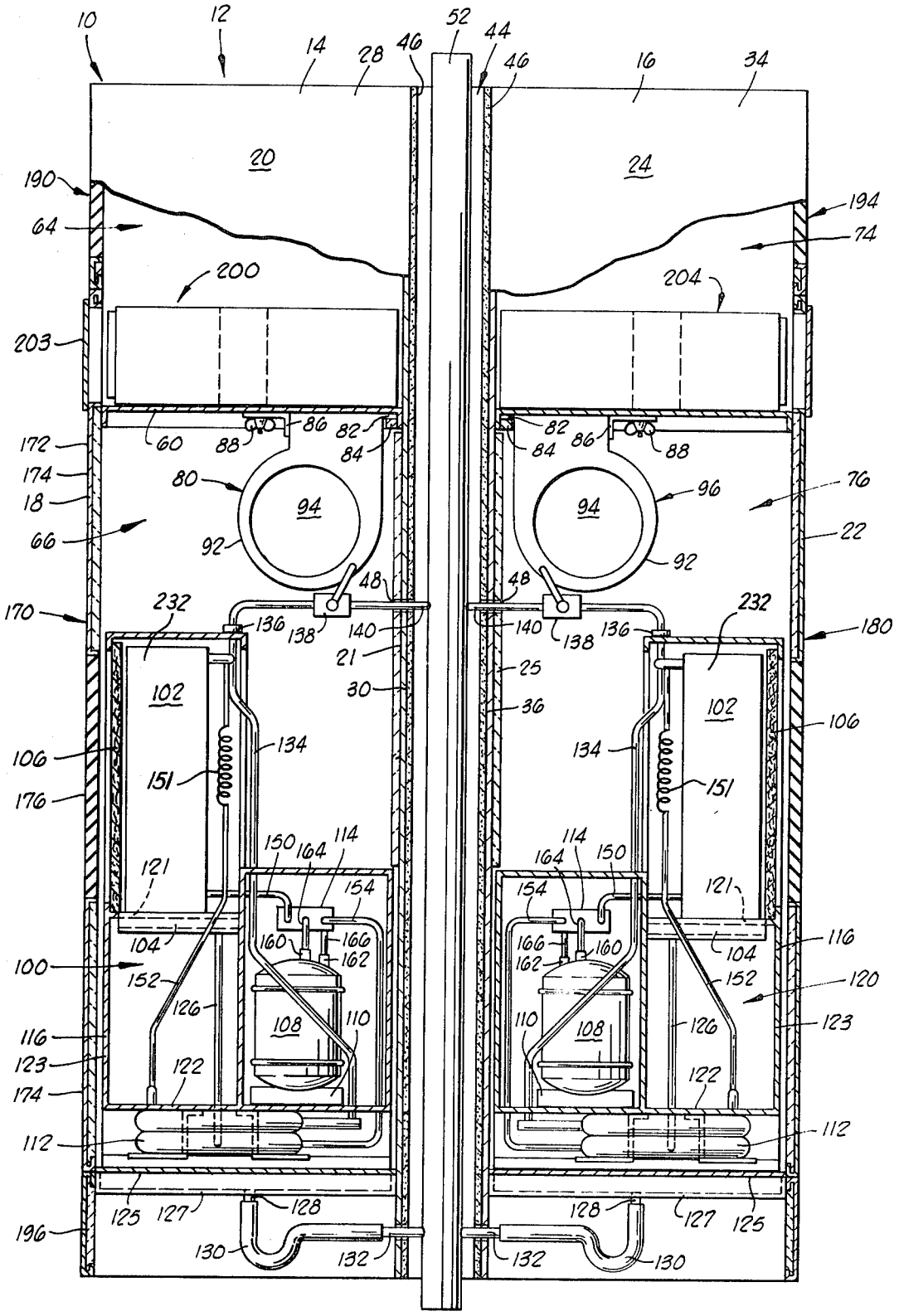
FIG. 1 is a side elevational view of the improved air conditioning apparatus of the present invention having the enclosure panels thereof partially cut away to show the working components. The unit is shown in partial cutaway detail to depict the construction of the apparatus more clearly.
Figure 2:
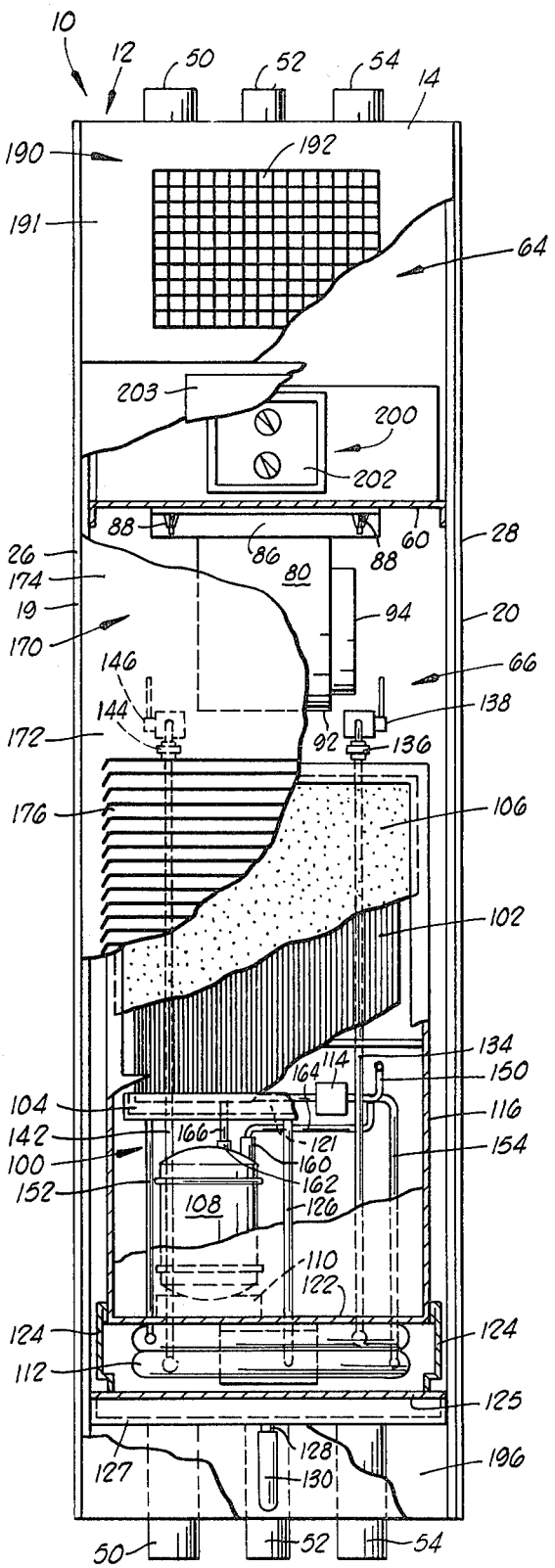
FIG. 2 is an elevational view of one end of the air conditioning apparatus shown in FIG. 1 with the intake grille assembly and base panel partially cut away in order to show the working components and the relationship of the intake grille assembly and filter to the air-to-refrigerant heat exchanger.

Referring to the drawings in general and particularly to FIGS. 1 and 2, the air conditioning apparatus of the present invention is generally designated by the reference numeral 10. The air conditioning apparatus 10 comprises a housing assembly 12 having a first housing compartment 14 and a second housing compartment 16. The first housing compartment 14 is of square cross-section and is characterized by four vertical sides, of which three are the access sides 18, 19 and 20. One of these three access sides may be selected as a component access side through which internal components of the air conditioning apparatus 10 may be reached for servicing and replacement. The fourth vertical side forming the first housing compartments 14 is disposed adjacent the supply, return and condensate drain riser pipes, to be described hereafter, and is thus not available for interior component access. This side will accordingly be termed the non-access side 21. In the same manner, the second housing compartment 16 is characterized by three access sides, 22, 23, and 24, of which one may be selected as a component access side, and a non-access side 25.

Selection of the component access side for each housing compartment will be dictated by the installation positioning of the air conditioning apparatus 10. Preferably, a component access side will be selected which permits maximum ease of access to the interior of the housing compartment for servicing operations. If only one access side of each housing compartment is to communicate with a room area, as in a "hideaway" type unit, then the access side communicating with the room area will be selected as the component access side. Additionally, since intake air heated or cooled by the air conditioning apparatus 10 will flow into the apparatus through the component access sides, it will be desirable to select component access sides which permit an unobstructed airflow from the room area being heated or cooled. For purposes of the present disclosure, the access side 18 has been designated the component access side for the first housing compartment 14, and the access side 22 has been designated the component access side for the second housing compartment 16. It will be understood, however, that other access sides could be selected as component access sides, if appropriate for a particular installation.

Figure 3:
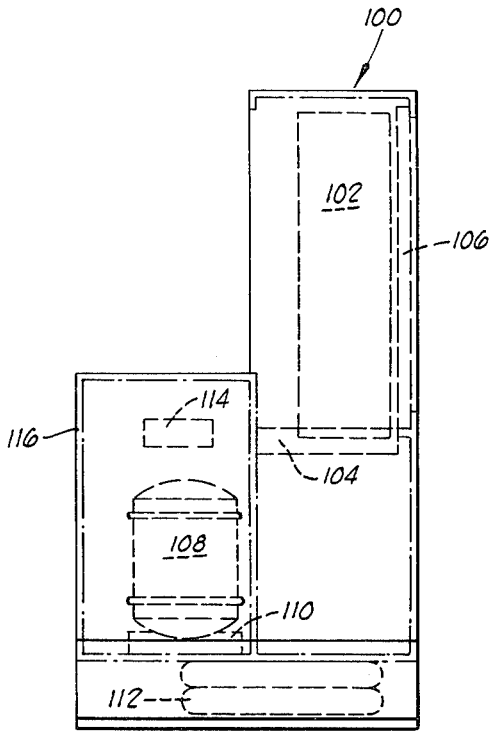
FIG. 3 is a top plan view of the air conditioning apparatus shown in FIG. 1 with the top panels removed to show the working components.
Figure 4:
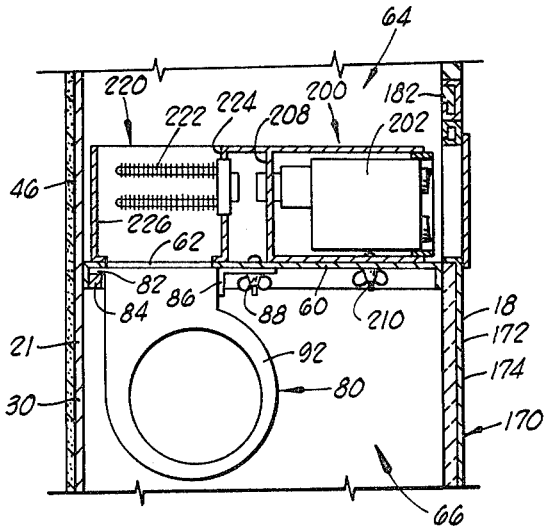
FIG. 4A is a schematic diagram of the heat pump assembly used in the air conditioning apparatus shown in FIG. 1 depicting the heat pump's operation in the cooling mode.
FIG. 4B is a schematic diagram of the heat pump assembly used in the air conditioning apparatus shown in FIG. 1 depicting the heat pump's operation in the heating mode.
Figure 3:
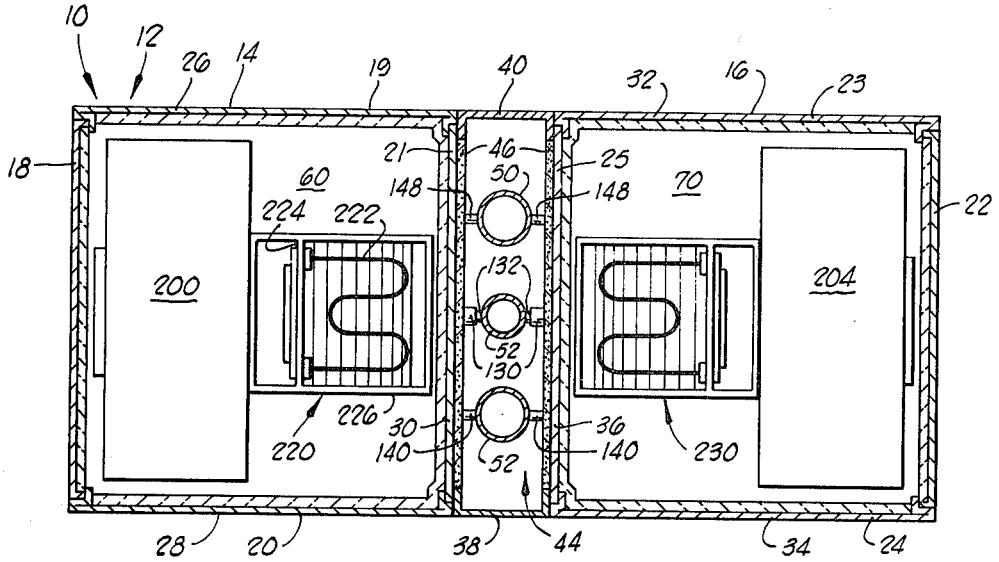

With reference to the first housing compartment 14, the access sides 19 and 20, which were not selected as the component access side, and the non-access side 21, are covered respectively by galvanized steel first enclosure panels 26, 28 and 30, as best shown in FIG. 3. These three enclosure panels, all of equal height, are conventionally connected to one another along their adjacent vertical edges via screws or the like, to form a box-like structure having an open side corresponding the component access side 18. In like manner, the access slides 23 and 24 and the non-access side 25 of the second housing compartment 16 are covered respectively by three second exclosure panels 32, 34 and 36 of equal height, which are connected at their adjacent vertical edges. The interior sides of each enclosure panel may be lined with coated glass fiber acoustic and thermal insulation.

Further defining the first housing compartment 14 is a square top panel (not shown) which is secured to the three first enclosure panels adjacent their upper edges, via conventional mechanical connections. In like manner, a square top panel is provided for the second housing compartment 16. The top panels have not been shown in FIG. 3 in order to permit better display of the other components of the air conditioning apparatus 10.

As best shown in FIG. 3, a vertically disposed first channel member 38 is secured to the first enclosure panel 30 of the first housing compartment 14 and to the second enclosure panel 36 of the second housing compartment. A second channel member 40 is likewise secured to the first and second enclosure panels 30 and 36 on the opposite side of the air conditioning apparatus 10. The first and second enclosure panels 30 and 36 and the first and second channel members 38 and 40 form a riser duct 44 between the first housing compartment 14 and the second housing compartment 16. A sheet of fire retardant insulation material 46 is adhered to that side of each of the enclosure panels 30 and 36 facing the riser duct 44. The insulation material 46 preferably constitutes a type C gypsum board of ⅝ inch thickness. As shown in FIG. 1, a clearance slot 48 is provided for conduits that extend into the riser duct 44, and a slotted neoprene rubber seal (not shown) may be provided to partially seal the clearance slot 48. The enclosure panels 30 and 36 and the fire retardant insulation material 46 serve to form a fire and sound barrier between the first and second housing compartments 14 and 16.

A supply riser pipe 50 and a return riser pipe 52 are vertically disposed in the riser duct 44 and fixably secured therein; the fixture means is not shown in the drawings, but it will be understood that conventional clamping means are utilized to establish the location of the riser pipes. In like manner, a condensate drain riser pipe 54 is also positioned in the riser duct 44 generally parallel to the supply and return riser pipes 50 and 52, and is fixedly secured therein.

The supply riser pipe 50 is connected to a source of heat transfer medium (not shown) and supplies heat transfer medium to the air conditioning apparatus 10 in a manner to be described hereafter. The condensate return drain riser pipe 52 and condensate drain riser pipe 54 are likewise connected to the source of heat transfer medium and return expanded heat transfer medium to the source from the air conditioning apparatus 10. Heat transfer medium returned by the return and condensate drain riser pipes 52 and 54 is transferred to a boiler or cooling tower, as required to re-establish the temperature of the medium at a level thermodynamically appropriate for operation of the air conditioning apparatus 10. Once this has been accomplished, the heat transfer medium is recycled to the supply riser pipe 50, and once again made available to the air conditioning appartus 10. For purposes of the present disclosure, the heat transfer medium will be considered to constitute water. However, it will be understood that any other appropriate heat transfer medium may be substituted, as required.

As shown in FIGS. 1, 2 and 3, a square shaped first mid-panel member 60 having an opening 62 is supported in a horizontal position by the first enclosure panels 26, 28 and 30 near the middle of the first housing compartment 14. The first mid-panel member 60 divides the first housing compartment 14 into an upper portion above the first mid-panel member 60 and into a lower portion below the first mid-panel member 60. The upper portion will be referred to as a first plenum section 64 and the lower portion will be referred to as a first operating section 66. Similarly, a square-shaped second mid-panel member 70 having an opening 72 is supported by the enclosure panels 22, 34, and 36 near the middle of the second housing compartment 16, thereby dividing the second housing compartment 16 into a second plenum section 74 and a second operating section 76.

The first and second mid-panel members 60 and 70 are generally of a square-shaped configuration so that each may be oriented in any one of three different directions. That is, the first mid-panel member 60 may be positioned with its opening 62 in close proximity to any one of the three access sides 18, 19 or 20 by simply turning the first mid-panel member 60 accordingly, and securing it in the desired orientation relative to the selected access side. Similarly, the second mid-panel member 70 may be positioned with its opening 72 in close proximity to any one of the three access sides 22, 23 or 24 by turning and securing the panel to the desired orientation. This selective orientation permits outlet air flowing from each housing compartment to be directed through any one of the three access sides of each housing compartment.

Disposed in the first operating section 66 is a first heat pump assembly 100, the major components of which are shown in FIG. 5, as viewed through the plane defined by access side 20. These major components include an air-to-refrigerant heat exchanger 102, which is disposed adjacent to an upper condensate tray 104 and a filter 106; a compressor 108 disposed on a compressor support block 110; a water-to-refrigerant heat exchanger 112 (also referred to herein as a medium-to-refrigerant heat exchanger); and a reversing valve assembly 114. All of the working components just listed are supported by a heat pump frame 116 which is removably supported by the first housing compartment 14 in the first operating section 66. The various connecting conduits are omitted in FIG. 5 so that the disposition of these components is more clearly viewable.

A second heat pump assembly 120 is disposed within the second operating section 76 of the second housing compartment 16. Because the components of the second heat pump assembly 120 are identical to those of the first heat pump assembly 100, the components of the second heat pump assembly 120 will not be described in detail. Rather, identical numerical designations will be assigned to the components of the second heat pump assembly 120, and it will be understood that the description given for the first heat pump assembly 100 will apply equally to the second heat pump assembly 120.

Figure 7:
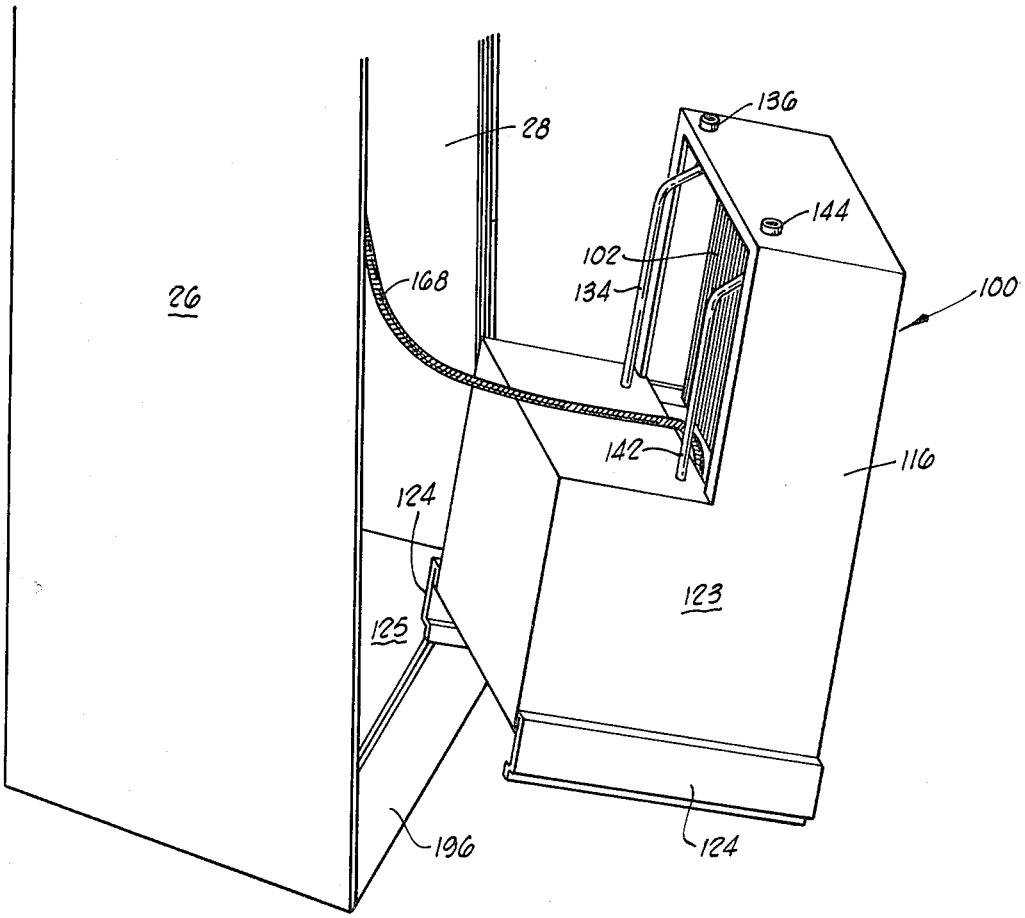
FIG. 7 shows the heat pump assembly being removed from the first housing compartment of the air conditioning apparatus of FIG. 1.

The heat pump frame 116 comprises a horizontal coil support member 121 and a parallel compressor support member 122, both carried by a support frame 123. Depending from the underside of the support frame 123 are two parallel rail members 124 disposed in sliding contact with an appropriately formed horizontal base member 125 connected to the first enclosure panels 26, 28 and 30 in the lower portion of the first housing compartment 14. As shown in FIG. 7, the rail members 124 and the base member 125 function to guide the heat pump frame 116 in and out of the first housing compartment 14, through the component access side 18, when removal or replacement is required. It will be understood that, while the heat pump frame 116 has been shown as removable through the access side 18 for purposes of the present disclosure, the heat pump frame 116 may be removed through any other access side which may be selected as the component access side.

Figure 8:
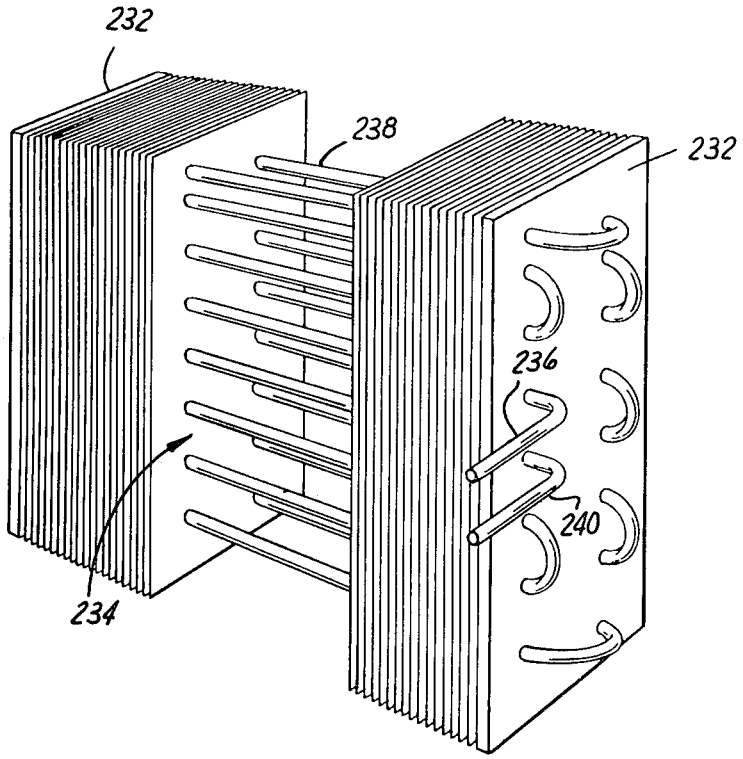
FIG. 8 shows the heat exchanger coil of the air-to-refrigerant heat exchanger of the air conditioning apparatus of FIG. 1. The central ribs of the exchanger are not shown, in order to permit better display of other components of the exchanger. Likewise, cross struts interconnecting the end members which from the heat exchanger frame are not shown.

Specifically, the first heat pump assembly 100 comprises an air-to-refrigerant heat exchanger (designated 102 in the drawings) which is of the type disclosed in the pending U.S. patent application Ser. No. 896,708, filed by Arthur L. Alford, and assigned to the assignee of the present invention. This type of air-to-refrigerant heat exchanger features a heat exchanger frame 232 (shown in FIG. 1) which supports a heat exchanger coil 234, shown in FIG. 8. The heat exchanger coil 234 comprises a first end portion 236, a medial portion 238, and a second end portion 240. The medial portion 238 passes sinuously between the ends of the heat exchanger frame 232 so that the first and second end portions of the coil 234 are disposed on the coil row first contacted by air blown through the heat exchanger. This arrangement permits each of the first and second coil end portions to serve as either the entering portion of the coil for the refrigerant, or as the final conditioning stage for the refrigerant as it exits the coil. This feature assures complete condensation or vaporization, and thus efficient and economical operation is assured when the air-to-refrigerant heat exchanger is used either as a condenser or as an evaporator, depending upon which mode of operation is selected for the heat pump assembly. The air-to-refrigerant heat exchanger 102 is supported in the first operating section 66 by the coil support member 121 carried by the heat pump frame 116, and is disposed adjacent the selected component access side 18.

Referring to FIG. 1, a first condensate collection assembly is provided for collection of condensed moisture produced by the first heat pump assembly 100. Comprising the condensate collection assembly is a first drain pan 104 and a first drain tube 126, which are supported within the heat pump frame 116. The first drain pan 104, situated below the air-to-refrigerant heat exchanger 102 and supported by the coil support member 121, provides means for collecting moisture which condenses from the air and drips downwardly from the coils of the air-to-refrigerant heat exchanger 102. A drain hole (not shown) is formed in the bottom of the first drain pan 104 and drains to the first drain tube 126. Further comprising the first condensate collection assembly is a second drain pan 127 disposed outside the heat pump frame 116 in the lower portion of the first housing compartment 14, in fluid-receiving relationship to the first drain tube 126. The second drain pan 127 has a centrally located drain aperture (not shown) which drains to a second drain tube 128 which is connected to the condensate drain riser pipe 54 by means of a flexible hose 130 and a stub nipple 132. A neoprene sheet (not shown) is slotted and forms a partial seal about the stub nipple 132 to seal a slot (not shown) in the first enclosure panel 30 through which the stub nipple 132 passes. In practice, the condensate drain riser pipe 54 is known to expand in its linear direction, causing the stub nipple 132 to move generally in an upward or downward direction, and the neoprene sheet is slotted to provide a seal at any position of the stub nipple 132 as it moves with the riser pipe 54.

The water-to-refrigerant heat exchanger 112 is disposed in the lower part of the heat pump frame 116 adjacent the underside of the compressor support member 122. Preferably, the water-to-refrigerant heat exchanger 112 will be a coaxial refrigerant condenser such as the Model S-1½ manufactured by Edwards Engineering Corporation, 101 Alexander Avenue, Pompton Plains, N.J. or the Model 150-S manufactured by Packless Industries, 152 N. Main Street, Mount Wolf, Pa. The water-to-refrigerant heat exchanger 112 is situated so that moisture from the air condensing on its surface will drip without obstruction into the second drain pan 127, the condensate therefrom then draining to the condensate drain riser pipe 54. The water-to-refrigerant heat exchanger is secured to the heat pump frame 116 by a pair of retaining members 133 connected to the underside of the compressor support member 122.

One end of the water coil of the water-to-refrigerant heat exchanger 112 is connected to a return conduit 134, which may be selectively bisected at a union coupling 136. The return conduit 134, which may selectively be opened and closed to fluid flow by a shut-off valve 138, extends through the enclosure panel 30 and the insulation material 46 and connects to the return riser pipe 52 via the stub nipple 140. A neoprene seal may be provided in the manner described above for the stub nipple 132. The union coupling 136 and shut-off valve 138 permit convenient removal of the first heat pump assembly 100 during servicing of the air conditioning apparatus 10.

In a similar manner, a supply conduit 142, best viewed in FIG. 2, is connected to the other end of the water coil of the water-to-refrigerant heat exchanger 112 and connects to the supply riser pipe 50 via a union coupling 144, a shut-off valve 146 and a stub nipple 148 (shown in FIG. 3).

Returning to FIG. 1, shown therein is the reversing valve assembly 114, having first and second operational modes, which is disposed within the heat pump frame 116; since the construction of the reversing valve assembly is conventional, it will not be described in detail herein. A first conduit 150 provides fluid refrigerant fluid communication between the air-to-refrigerant heat exchanger 102 and the reversing valve assembly 114, the first conduit 150 extending from the lower coil end 240 of the air-to-refrigerant heat exchanger 102 to the reversing valve assembly 114.

A second conduit 152 provides refrigerant fluid communication between the water-to-refrigerant heat exchanger 112 and the air-to-refrigerant heat exchanger 102, and is connected to the opposite end 236 of the air-to-refrigerant heat exchanger 102 and to one coil of the refrigerant loop of the water-to-refrigerant heat exchanger 112. A pressure-reducing means 151 is disposed in the second conduit 152 in order to reduce by a predetermined amount the pressure of refrigerant flowing through the second conduit 152. Preferably, the pressure-reducing means will comprise a capillary tube disposed to receive and pass refrigerant flowing within the second conduit 152; such a capillary tube is conventional in the heat exchanger art, and its construction will not be described herein.

A third conduit 154 provides refrigerant fluid communication between the water-to-refrigerant heat exchanger 112 and the reversing valve assembly 114, and is connected at one end to the coil end of the refrigerant loop of the water-to-refrigerant heat exchanger 112 and at its other end to the reversing valve assembly 114.

The compressor 108, of conventional design, is supported by the compressor support block 110 which in turn is supported by the compressor support member 122 of the heat pump frame 116. The suction port 160 and the pressure port 162 of the compressor 108 are in refrigerant fluid communication with the reversing valve assembly 114 via conduits 164 and 166, respectively, which serve as port conduit means. The reversing valve assembly 114 is electrically actuated in a conventional manner to selectively assume a first operational mode and a second operational mode. The operation of the reversing valve assembly 114 will be discussed below, and at this point it is sufficient to note that the reversing valve assembly 114 selectively directs the flow of refrigerant fluid in the heat pump assembly 100. The electrical wiring 168 for energizing the motor of the compressor 108 and the reversing valve assembly 114 is partially shown in FIG. 7. This wiring is conventional, and will not be described further for purposes of the present disclosure.

In operation, the refrigerant loop just described, comprising the air-to-refrigerant heat exchanger 102, the compressor 108, the water-to-refrigerant heat exchanger 112, the reversing valve assembly 114, the connecting first, second and third conduits 150, 152, and 154, and the suction and pressure port conduit means 164 and 166, are charged with a conventional fluid refrigerant, such as Freon.

With continued reference to FIGS. 1 and 2, a first blower 80 is supported by the first mid-panel member 60 and is disposed in the first operating section 66 by means more clearly shown in the enlarged view of FIG. 6. The first blower 80 has a longitudinal member 82 attached along one of its top edges that is engaged by a retaining member 84 attached to the underside of the first mid-panel member 60 in the manner shown. A longitudinal member 86 is attached along an opposite edge of the blower 80, in parallel relation to the longitudinal member 82. Several threaded stud bolts 88 (one of which is shown having a wing nut retainer) extend from the first mid-panel member 60 and securedly pass through apertures in the longitudinal member 86. This arrangement affords quick removal of the first blower 80 from hanging engagement with the first mid-panel member 60, and it also provides for easy placement thereof, with correct alignment being assured by the positive guiding action of the described connector.

The first blower 80 is a centrifugal, direct drive type of blower which functions to draw air from the first operating section 66 and to blow the air into the first plenum section 64. The first blower 80 is disposed in the first operation section 66 and draws air through the air to refrigerant heat exchanger 102 previously described. The first blower 80 has a scroll blower unit 92 of conventional design and a driving motor 94.

A second blower 96, identical in construction to the first blower 80, is supported by the second mid-panel member 70 and is disposed in the second operating section 76 by means identical to that employed to support the first blower 80. That is, the second blower 96 also has a longitudinal member 82 and a longitudinal member 86 attached along top edges thereof and supported, respectively, by a retaining member 84 and several threaded stud bolts 88.

It will be noted that the blowers 80 and 96 are disposed respectively in the first and second operating sections 86 and 76 in air drawing relationship to the heat pump assemblies 100 and 120. Because of the location of the blowers 80 and 96, the motors of these blowers are subjected to the effects of the air passing through the air to refrigerant heat exchanger 102, and since this air has been heated when the heat pump assemblies 100 and 120 are in the heating mode, the motors must be characterized by relatively small internal heat dissipation. That is, the motors of the blowers 80 and 96 are permitted smaller operating temperature rises over ambient temperatures (approximately 15° F. or 80° C.), as compared to conventional motors, which are normally permitted up to about 70° F. (39° C.) rise over ambient. Suitable motors for the purpose of the present invention are manufactured by General Electric Company as the thermally protected shade pole model 5KSP29BK or as the thermally protected split capacitor model 5KCP29BK. With the blowers 80 and 96 disposed in the more spacious operating sections 66 and 76 of the first and second housing compartments 14 and 16, larger scroll blowers can be used instead of the tightly wound scroll blowers normally used when such blowers are located in the plenum sections of air conditioning units. Since a larger scroll can be used, less electrical power per unit of air moved is experienced, and the blowers may operate more quietly than in conventional units.

The electrical connections to the first and second blowers 80 and 96 are not shown in the Figures, as such connections are conventional and need not be discussed for the purpose of this disclosure. It is suggested that the electrical wiring to the first and second blowers 80 and 96 be disposed in flexible conduits, and that a slack loop be placed in each conduit so as to permit the removal of each blower fan for inspection and repair without electrical disconnection.

With continued reference to FIGS. 1 and 2, a first intake grille assembly 170 is removably supported along the component access side 18 of the first housing compartment 14 adjacent to and in front of the air-to-refrigerant heat exchanger 102 of the first heat pump assembly 100. The first intake grille assembly 170 comprises a door panel 172 having a solid section 174 and an air passing, louvered grille section 176. The solid section 174 does not permit air passage, but the grille section 176 permits air to pass via the door panel 172 to the air-to-refrigerant heat exchanger 102. Disposed behind the door panel 172 within the first housing compartment 14, is the filter 106 which filters the air passing through the door panel 172. This filter is removably supported by the heat pump frame 116, so that it may be changed or cleaned as may be required.

In like manner, a second intake grille assembly 180 is removably supported by the second housing compartments 16 adjacent to the component access side 22, and in front of the air-to-refrigerant heat exchanger 102 of the second heat pump assembly 120. Because the second intake grille assembly 180 is identical to the first intake grille assembly 170 described above, the construction of the second intake grille assembly 180 will not be described further.

The door panel 172 is disposed within vertical flanges provided on the enclosure panels 26 and 28 adjacent the component access side 18, and is removably secured to the first housing compartment 14 via conventional mechanical fasteners (not shown). In like manner the door panel of the second intake grille assembly 180 is secured by mechanical fasteners to the second housing compartment 16, in contact with vertical flanges of the enclosure panels 32 and 34.

When the mechanical fasteners are released, the first and second intake grille assemblies 170 and 180 may be removed from the air conditioning apparatus 10, thereby leaving access ports in the component access sides 18 and 22. These access ports permit removal of the first and second heat pump assemblies 100 and 120 for servicing. Once the heat pump assemblies 100 and 120 are removed, the first and second blowers 80 and 96 are also accessible for servicing.

A first outlet grille assembly 190 formed from a solid outlet panel 191, having a louvered grille section 192, is supported along one of the access sides 18, 19 or 20 by conventional mechanical fasteners. First outlet grille assembly 190 should be disposed on that access side through which outlet airflow best services the room area heated and cooled by the first heat pump assembly 100. It may be that the first housing compartment 14 of the air conditioning apparatus 10 will be required to service more than one occupancy area, and this may be achieved by providing a first outlet grille assembly 190 for the access side corresponding to each occupancy area. In some installations having plural outlet grilles 190, there exists the possibility of light or sound travelling from one occupancy area through the unit to another occupancy area serviced by the same unit. Appropriately disposed baffles may be placed in the first plenum section 64 to prevent this undesirable result. One or more second outlet grille assemblies 194, identical to the first outlet grille assembly 190 just described, may be disposed at the access sides 22, 23 and 24 in a similar manner.

In order to provide complete covering for the component access side 18 of the first housing compartment 14, a base panel 196, shown in FIG. 7, may be secured to the enclosure panels 26 and 28, so as to cover the component access side 18 below the first intake grille assembly 170. In like manner, a base panel may be secured to the component access side 22 of the second housing compartment 16. If desired, the base panels, as well as the portions of the intake and outlet grille assemblies which do not permit air passage, may be lined with the same insulation material used to line the interior sides of the first and second enclosure panels.

As most clearly shown in FIG. 6, as well as in FIGS. 1, 2 and 3, a first control assembly 200 is disposed in the first plenum section 64 and is supported by the first mid-panel member 60 in close proximity to the access side selected to hold the first outlet grille assembly 190 (access side 18 for purposes of this disclosure). The first control assembly 200 features a temperature sensor (not shown) extending through the access side 18. The positioning of the temperature sensor relative to the access sides 18, 19 or 20 may be selected by appropriate orientation of the first mid-panel member 60. The first control assembly 200 further comprises conventional thermostat means and associated circuitry for controlling operation of the blower 80 and compressor 102 in response to the temperature sensor, so as to maintain the room area service by the heat pump assembly 100 at a control temperature, selected by a room occupant. The control temperature may be selectively varied by a room occupant via a temperature control 202 disposed in an opening in the first outlet grille assembly 190 and covered by a hinged door member 203. The second control assembly 204, identical in construction to the first control assembly 200, is disposed in the second plenum section 74 and is supported by the second mid-panel member 70 to extend through the second access side 22. As was discussed with regard to the first mid-panel member 60, the orientation of the second mid-panel member 70 determines the position of the second control assembly 204 relative to its respective access sides.

As viewed in FIG. 6, the first control assembly 200 has a supporting frame 208 which attaches to the first mid-panel member 60 via a bolt and wing nut 210. This permits the first control assembly 200 to be reached for service and repair through the opening 62 of the first mid-panel member 60. The second control assembly 204 is similarly constructed and supported. Preferably, all electric connections to the control assemblies 200 and 204, and to the blowers 80 and 96, are provided with mating plugs and receptacles so that these components may be easily removed from the air conditioning apparatus 10 as may be required for servicing.

The embodiment of the present invention, illustrated in FIGS. 1 through 6, is equipped in the first plenum section 64 with an auxiliary first electrical heater 220 which has a resistance wire coil 222 supported by a plate 224 which is one side of a box 226 supported by the first mid-panel member 60 and which serves as an extension to the nozzle of the first blower 80, through which the air exiting from the first blower 80 must pass. In like manner, a second electrical heater 230 is provided in the second plenum section 74 above the second blower 96. The structure of the first and second heaters 220 and 230 is conventional and their inclusion herein is an optional addition to the heating capability of the first and second heat pump assemblies 100 and 120. The appropriate electrical wiring necessary to operate the first and second electrical heaters 220 and 230 is not shown in the drawings. The first and second electrical heaters 220 and 230 may be utilized as the sole heating means for the air conditioning apparatus 10, eliminating the need for a boiler for supplying heated water to the heat pump assemblies 100 and 120. In the event that a boiler is provided for use in conjunction with the air conditioning apparatus 10, the electric heaters 220 and 230 may not be necessary, or may function exclusively as winter backup units for the heat pump assemblies 100 and 120.

Some government fire regulations may require, when the air conditioning apparatus 10 is provided with electrical heaters 220 and 230, that the plenum sections 64 and 74 be enclosed by fire retardant material or by a metal sheet. This is readily achievable once the orientation of the working components is selected relative to the access sides of the housing assembly 12. It should be noted that such a fire-resistant enclosure (not shown) in the Figures) does not impede the accessibility of either the first or second operating sections 66 and 76, which is an important feature of the air conditioning apparatus 10.

In the embodiment of the air conditioning apparatus 10 described herein, the components disposed in the first housing compartment 14 and the second housing compartment 16 have been stated to be of identical construction, as would be the case if the two room areas to be heated or cooled present substantially identical heating and cooling loads to the air conditioning apparatus 10. However, if the heating and cooling loads of the two room areas differ substantially, then the components disposed in the housing compartment 14 and 16 may be constructed with heating and cooling capacities differing from each other. Variations in heating and cooling capacity may be obtained by installing heat pump components of various sizes and providing motor driven blowers of various capacities.

Figure 4A:
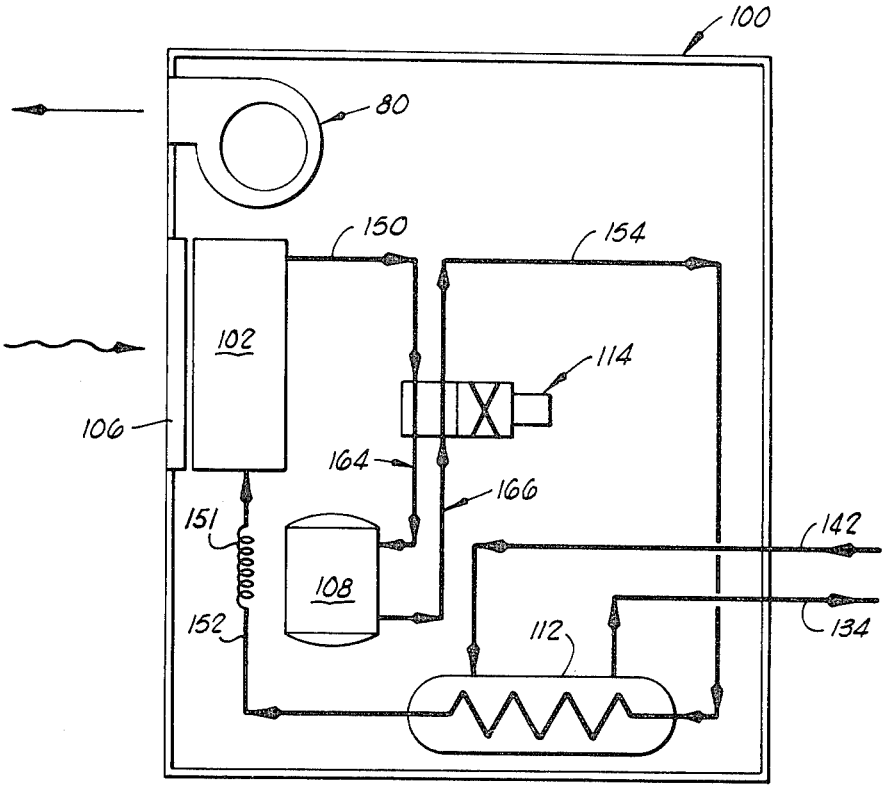

In order to cool a room area, the air-to-refrigerant heat exchanger 102 of the first heat pump assembly 100 will function as an evaporator. Referring to FIG. 4A, which is a schematic diagram representing the first heat pump assembly 100 in its cooling mode, the reversing valve assembly 114 is positioned in its first operational mode to effect the passage of heated refrigerant gas leaving the compressor 108, via the conduit 166 and via the conduit 154, to the water-to-refrigerant heat exchanger 112 where the refrigerant gas will condense to a liquid and be cooled by the recirculating water that is passed through the water coil of the heat exchanger 12 by means of the conduits 142 and 134. The liquid refrigerant then flows through a pressure reducing means, such as a capillary tube 151, and then to the air-to-refrigerant heat exchanger 102 via the conduit 152. The refrigerant evaporates in the heat exchanger 102 as the air drawn therethrough absorbs heat from the evaporating refrigerant. The refrigerant gas passes from the heat exchanger 102 via the conduit 150 to the reversing valve assembly 114 and to the compressor 108 via the conduit 164, where the refrigerant is pressurized for another cooling cycle.

Figure 4B:
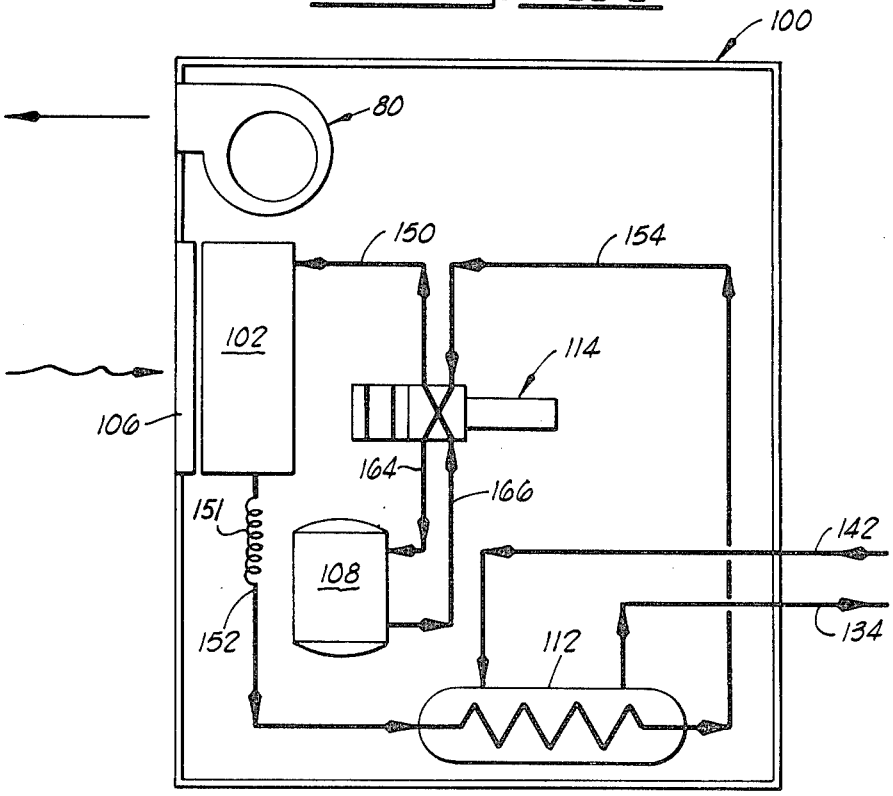

When the air conditioning apparatus 10 is operated to heat a room area, the heat exchanger 102 will function as a condenser, and the first heat pump assembly 100 will be in the heating mode as illustrated by the schematic diagram of FIG. 4B. The reversing valve assembly 114 is positioned in its second operational mode to pass the compressed refrigerant gas from the conduit 166 to the conduit 150, which passes the hot refrigerant gas to the air-to-refrigerant heat exchanger 102. As the refrigerant passes through the heat exchanger 102, it will condense to a liquid, giving up its heat to the room air being drawn through the heat exchanger 102 by the first blower 80. The cooled refrigerant liquid will leave the air-to-refrigerant heat exchanger 102 via the conduit 152, expand while passing through the capillary tube 151, and pass through the refrigerant coil in the water-to-refrigerant heat exchanger 112, where the refrigerant liquid will be heated by the water routed through the water coil of the heat exchanger 112 by means of the conduits 142 and 134. The heated refrigerant gas will pass from the heat exchanger 112 to the reversing valve assembly 114 via the conduit 154. The reversing valve assembly 114 will route the refrigerant to the compressor 108 via the conduit 164, and the compressor 108 will pressurize the refrigerant gas for another heating cycle. The proper coordination and timing of the operation of the first blower 80 and the first heat pump assembly 100 are accomplished by the first control assembly 200 in response to the sensed temperature of the room area being serviced by the first heat pump assembly 100.

Since the second heat pump assembly 120 is identical to the first heat pump assembly 100 just described, it will not be necessary to describe the operation of the second heat pump assembly 120 separately. It will be noted that the heat pump assemblies 100 and 120 operate independently, and that the operation of the second blower 96 is coordinated with the second heat pump assembly 120 by the second control assembly 204 disposed in the second housing compartment 16. With this in mind, the operation of the air conditioning apparatus 10 relative to the components disposed in the first housing 14 will be continued.

During warmer months, when cooling operation is ordinarily desired by the user of the air conditioning apparatus 10, the water furnished to the water-to-refrigerant heat exchanger 112 will usually be cooled by a cooling tower. During the cooler months when heating operation is required, the water supply to the heat exchanger 112 will usually be heated by a boiler. In order to supplement the heating action of the heat pump assemblies 100 and 120 during winter months, the air conditioning apparatus 10 may be provided with the auxiliary electrical heaters 200 and 230 to heat the air exhausted from the blowers 80 and 96. The operation of the electrical heaters 220 and 230 is conventional, and actuation thereof is controlled respectively by the control assemblies 200 and 204. The blowers 80 and 96 are interlocked with the electrical heaters 200 and 230 to insure that each of the heaters 220 and 230 is energized only when its respective blower is operating.

Referring to the first housing compartment 14, it will be clear that complete access to all of the working components disposed therein for inspection and repair is provided by the removal of the first intake grille assembly 170 from the housing assembly 12. This provides an access port through which access to the interior of the first housing compartment 14 is gained, and through which components may be reached or removed as required for repair or replacement. This first heat pump assembly 100 may be removed after closing the shutoff valves 138, 146 and disconnecting the return and supply conduits 134 and 142 at the union couplings 136 and 144. After this is achieved, the entire first heat pump assembly 100 is simply removed by sliding it from the first housing compartment 14 on the rail members 124 via the access port, as shown in FIG. 7. If required, the first blower 80 next may be easily removed from the first mid-panel member 60 by removing the retaining wing nuts from the stud bolts 88, and by pulling the first blower 80 down and towards the access port created by the removal of the first intake grille assembly 170. Sufficient slack is provided in the electrical connections to allow pulling the first blower 80 outside the first housing compartment 14. In like manner, the first electrical heater 220 and the first control assembly 200 are easily removed (once the first blower 80 has been removed) by removing the retaining wing nuts from the remaining stud bolts 88. This permits the lowering of the first control assembly 200 and the first electrical heater 220 through the opening 62, and the plug-in electrical connections permit the quick disconnection of these components. As discussed above, it need only be mentioned that access to the components disposed in the second housing compartment 16 is provided in like manner to that just described for the first housing compartment 14, except that it should be noted that the access port is created by the removal of the second intake grille assembly 180 from the housing assembly 12.

It is clear that the present invention is well adapted to carry out the objects and to attain the ends and advantages mentioned as well as those inherent therein. While a presently preferred embodiment has been described for purposes of this disclosure, numerous changes may be made which will readily suggest themselves to those skilled in the art and which are accomplished within the spirit of the invention disclosed and as defined in the appended claims.

What is claimed is:

1. An improved air conditioning apparatus of the type requiring connection to a source of heat transfer medium for providing simultaneous air conditioning to a first room area and to a second room area on the same floor of a structure, the apparatus comprising:

a housing assembly comprising a first housing compartment having a square cross-section associated with the first room area and a second housing compartment having a square cross-section associated with the second room area, the first housing compartment having three access sides and the second housing compartment having three access sides;

a first mid-panel member having an opening therethrough and supported by the first housing compartment so that the first mid-panel member separates the second housing compartment into an upper second plenum section and a lower second operating section;

a first blower supported by the first mid-panel member in the first operating section and disposed to blow air from the first operating section through the opening in the first mid-panel member into the first plenum section;

a second blower supported by the second mid-panel member in the second operating section and disposed to blow air from the second operating section through the opening in the second mid-panel member into the second plenum section;

a first heat pump assembly having a first air-to-refrigerant heat exchanger and supported by the first housing compartment in the first operating section so that the first air-to-refrigerant heat exchanger is positioned along a selected component access side of the first housing compartment;

a second heat pump assembly having a second air-to-refrigerant heat exchanger and supported by the second housing compartment in the second operating section so that the second air-to-refrigerant heat exchanger is positioned along a selected component access side of the second housing compartment;

first control means for sensing the temperature of the air in the first room area and for controlling the operating of the first blower and the first heat pump assembly in response thereto;

second control means for sensing the temperature of the air in the second room area and for controlling the operation of the second blower and the second heat pump assembly in response thereto;

a first outlet grille assembly supported by the first housing compartment along a selected one of the access sides thereof, the access side selectable in response to the air conditioning requirements of the first room area, and disposed to direct air from the first plenum section to the first room area;

a second outlet grille assembly supported by the second housing compartment along a selected one of the access sides thereof, the access side selectable in response to the air conditioning requirements of the second room area, and disposed to direct air from the second plenum section to the second room area;

a first intake grille assembly removably supported by the first housing compartment and positionable at the selected component access side thereof in intake air relationship to the first air-to-refrigerant heat exchanger, the first intake grille assembly defining when removed an access port through which the first blower and the first heat pump assembly are selectively removable from the first operating section;

a second intake grille assembly removably supported by the second housing compartment and positionable at the selected component access side thereof in intake air relationship to the second air-to-refrigerant heat exchanger, the second intake grille assembly defining when removed an access port through which the second blower and the second heat pump assembly are selectively removable from the second operating section;

supply means for providing fluid communication from the source of heat transfer medium to the first and second heat pump assemblies;

return means for providing fluid communication from the first and second heat pump assemblies to the source of heat transfer medium; and condensate drain means for collecting and disposing of condensate from the first and second heat pump assemblies.

2. The apparatus of claim 1 wherein the first heat pump assembly is further characterized as comprising:

a first medium-to-refrigerant heat exchanger in which a refrigerant and the heat transfer medium may pass in heat exchange relationship;

a compressor having a suction port and a pressure port;

a reversing valve assembly having a first operational mode and a second operational mode;

first conduit means for providing fluid flow communication between the first air-to-refrigerant heat exchanger and the reversing valve assembly;

second conduit means for providing fluid flow communication between the first air-to-refrigerant heat exchanger and the first medium-to-refrigerant heat exchanger, the first air-to-refrigerant heat exchanger having fluid communication therethrough between the first and second conduit means so that a refrigerant is passable therethrough in heat exchange relationship to air contacting the first air-to-refrigerant heat exchanger;

third conduit means for providing fluid flow communication between the first medium-to-refrigerant heat exchanger and the reversing valve assembly, the first medium-to-refrigerant heat exchanger having fluid communication therethrough between the second and third conduit means so that a refrigerant is passable therethrough in heat exchange relationship to the heat transfer medium;

fourth conduit means for providing fluid flow communication between the reversing valve assembly and the compressor, the reversing valve assembly having selective routing of fluid therethrough so that when the reversing valve assembly is in the first operational mode the first conduit means is fluid-coupled with the suction port of the compressor and the third conduit means is fluid-coupled with the pressure port of the compressor, and when the reversing valve assembly is in the second operational mode, the first conduit means is fluid-coupled with the pressure port of the compressor and the third conduit means is fluid-coupled with the suction port of the compressor; and pressure-reducing means interdisposed in the second conduit means for reducing the pressure of a refrigerant flowing through the second conduit means by a predetermined amount.

3. The apparatus of claim 2 wherein the second heat pump assembly is further characterized as comprising:

a second medium-to-refrigerant heat exchanger in which a refrigerant and the heat transfer medium may pass in heat exchange relationship;

a compressor having a suction port and a pressure port;

a reversing valve assembly having a first operational mode and a second operational mode;

first conduit means for providing fluid flow communication between the second air-to-refrigerant heat exchanger and the reversing valve assembly;

second conduit means for providing fluid flow communication between the second air-to-refrigerant heat exchanger and the second medium-to-refrigerant heat exchanger, the second air-to-refrigerant heat exchanger having fluid communication therethrough between the first and second conduit means so that a refrigerant is passable therethrough in heat exchange relationship to air contacting the second air-to-refrigerant heat exchanger;

third conduit means for providing fluid flow communication between the second medium-to-refrigerant heat exchanger and the reversing valve assembly, the second medium-to-refrigerant heat exchanger having fluid communication therethrough between the second and third conduit means so that a refrigerant is passable therethrough in heat exchange relationship to the heat transfer medium;

fourth conduit means for providing fluid flow communication between the reversing valve assembly and the compressor, the reversing valve assembly having selective routing of fluid therethrough so that when the reversing valve assembly is in the first operational mode the first conduit means is fluid-coupled with the suction port of the compressor and the third conduit means is fluid-coupled with the pressure port of the compressor, and when the reversing valve assembly is in the second operational mode, the first conduit means is fluid-coupled with the pressure port of the compressor and the third conduit means is fluid-coupled with the suction port of the compressor; and pressure-reducing means interdisposed in the second conduit means for reducing the pressure of a refrigerant flowing through the second conduit means by a predetermined amount.

4. The apparatus of claim 3 further comprising:

a first electrical heater supported by the first mid-panel member in the first plenum section and disposed in air-heating relationship to the air blown by the first blower to the opening in the first mid-panel member; and a second electrical heater supported by the second mid-panel member in the second plenum section and disposed in air-heating relationship to the air blown by the second blower through the opening in the second mid-panel member.

5. The apparatus of claim 3 or 4 further comprising:

first enclosure panels enclosing the first housing compartment along the two access sides thereof that are not selectesd as the component access side along which the first air-to-refrigerant heat exchanger is disposed; and second enclosure panels enclosing the second housing compartment along the two access sides that are not selected as the component access side along which the second air-to-refrigerant heat exchanger is disposed.

6. The apparatus of claim 1 wherein the supply means comprises a supply riser pipe secured to the housing assembly and the return means comprises a return riser pipe secured to the housing assembly.

7. The apparatus of claim 1 wherein the condensate drain means comprises:

a condensate drain riser pipe secured to the housing assembly;

a first condensate collection assembly supported by the housing assembly below the first heat pump assembly; and a second condensate collection assembly supported by the housing assembly below the second heat pump assembly.

8. The apparatus of claim 1 wherein the first air-to-refrigerant heat exchanger of the first heat pump assembly and the second air-to-refrigerent heat exchanger of the second heat pump assembly are each characterized as comprising:

a heat exchanger frame; and a heat exchanger coil supported by the heat exchanger frame having a first end portion, a medial portion and a second end portion, the first end portion disposed in heat exchange relationship to a first portion of entering heat exchange air, and the second end portion disposed in heat exchange relationship to a second portion of the entering heat exchange air.

9. The apparatus of claim 3 wherein the pressure reduction means of the first heat pump assembly and wherein the pressure-reducing means of the second heat pump assembly are each defined as comprising:

a capillary tube disposed to receive and pass a refrigerant flowing between the air-to-refrigerant heat exchanger and the medium-to-refrigerant heat exchanger.

* * * * *

UNITED STATES PATENT AND TRADEMARK OFFICE

CERTIFICATE OF CORRECTION

PATENT NO. : 4,462,460

DATED : Jul. 31, 1984

INVENTOR(S) : Alvin S. Braver

It is certified that error appears in the above-identified patent and that said Letters Patent are hereby corrected as shown below:

Column 4, line 33, the word "from" should be --form--.

Column 5, line 23, the word "slides" should be --sides--.

Column 5, line 26, the word "exclosure" should be --enclosure--.

Column 6, line 36, the numeral "22" should be --32--.

Column 13, line 37, the numeral "12" should be --112--.

Signed and Sealed this

*Twenty-ninth* Day of *January 1985*

[SEAL]

*Attest:*

DONALD J. QUIGG

*Attesting Officer* *Acting Commissioner of Patents and Trademarks*